US006886348B2

(12) United States Patent
Ogura

(10) Patent No.: US 6,886,348 B2
(45) Date of Patent: May 3, 2005

(54) STIRLING REFRIGERATING MACHINE

(75) Inventor: Yoshiaki Ogura, Sakai (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/415,560

(22) PCT Filed: Oct. 30, 2001

(86) PCT No.: PCT/JP01/09527

§ 371 (c)(1),
(2), (4) Date: May 1, 2003

(87) PCT Pub. No.: WO02/37036

PCT Pub. Date: May 10, 2002

(65) Prior Publication Data

US 2004/0093873 A1 May 20, 2004

(30) Foreign Application Priority Data

Nov. 1, 2000 (JP) ..... 2000-334199

(51) Int. Cl.[7] ..... F25B 9/00
(52) U.S. Cl. ..... 62/6
(58) Field of Search ..... 62/6; 60/520

(56) References Cited

U.S. PATENT DOCUMENTS 4,798,054 A * 1/1989 Higham ..... 62/6
4,822,390 A 4/1989 Kazumoto et al.
5,142,872 A 9/1992 Tipton
5,351,490 A * 10/1994 Ohishi et al. ..... 62/6
5,385,021 A 1/1995 Beale
5,647,217 A 7/1997 Penswick et al.
6,209,328 B1 * 4/2001 Kim et al. ..... 62/6
6,467,276 B2 * 10/2002 Chung et al. ..... 62/6
2001/0015068 A1 * 8/2001 Chung et al. ..... 62/6

FOREIGN PATENT DOCUMENTS

EP 0437678 A2 7/1991
JP 4-335962 A 11/1992
JP 4-335963 A 11/1992
JP 4-347460 A 12/1992
JP 5-69564 U 9/1993
JP 8-35729 A 2/1996
JP 10-197081 A 7/1998
JP 2000-274854 A 10/2000

* cited by examiner

*Primary Examiner*—William C. Doerrler
(74) *Attorney, Agent, or Firm*—Birch, Stewart, Kolasch & Birch, LLP

(57) ABSTRACT

A Stirling refrigerator has an outer yoke assembly (11) provided as an outer yoke constituting a linear motor (16) and has a piston-support-spring support member (14A) and a displacer-support-spring support member (14B) that are supported by the outer yoke assembly (11) for fixing a piston support spring (5) and a displacer support spring (6) respectively. By the above-described structure, it is achieved to facilitate handling, in assembly of mass production, of a bobbin/coil and an outer yoke of an outer yoke body constituting the linear motor and reduce the size of the outer shape of a casing.

9 Claims, 8 Drawing Sheets

STIRLING REFRIGERATING MACHINE

This application is the national phase under 35 U.S.C. § 371 of PCT International Application No. PCT/JP01/09527 which has an International filing date of Oct. 30, 2001, which designated the United States of America.

TECHNICAL FIELD

The present invention relates to a Stirling refrigerator used for generation of low temperatures and more specifically, to a structure of a linear motor for reciprocating a piston, a structure of piston elastic support means supporting the piston and a structure of displacer elastic support means supporting a displacer.

BACKGROUND ART

A free-piston Stirling refrigerator for generating cold heat is also called reverse Stirling refrigerator in terms of heat cycle. This Stirling refrigerator has a structure as described below with reference to FIG. 12.

A conventional Stirling refrigerator 100E has a cylinder 3 including a linearly reciprocating piston 1 and a displacer 2. Piston 1 and displacer 2 are coaxially structured and a rod 2*a* formed on displacer 2 passes through a slide hole 1*a* provided in a central part in the axial direction of piston 1. Piston 1 and displacer 2 are provided to be smoothly sidable along an inner-periphery slide surface 3*a* of cylinder 3.

At an upper part (on the right side in FIG. 12) of rod 2*a* formed on displacer 2, respective central parts of a piston support spring 5 and a displacer support spring 6 are fixed. Piston support spring 5 and displacer support spring 6 are each in the shape of a spiral disk-like panel.

Piston 1 is elastically fixed with respect to casing 15 by piston support spring 5 supported by a support member 31 fixed to casing 15. Displacer 2 is also elastically fixed with respect to casing 15 by displacer support spring 6 supported by support member 31.

The internal space formed by cylinder 3 is divided into two spaces by piston 1. A first space is a working space 7 formed at the side of displacer 2 with respect to piston 1. A second space is a back space 8 formed at the opposite side of displacer 2 with respect to piston 1. These two spaces are filled with such a working medium as helium gas at high pressure.

A linear motor 16 includes an inner yoke 13 fixed to cylinder 3, an outer yoke body 9 formed of an outer yoke 9*b* placed with a predetermined gap between itself and inner yoke 13 to enclose a bobbin/coil 9*a*, and a permanent magnet 12 attached to piston 1 and placed in the gap between inner yoke 13 and outer yoke 9*b*. Outer yoke 9*b* is fixed to casing 15 by a positioning block 30 supported by support member 31.

Piston 1 is axially reciprocated at predetermined cycles by the action of linear motor 16. The reciprocating motion of piston 1 causes the working medium to be repeatedly compressed and expanded in working space 7. Displacer 2 is linearly reciprocated by a change in pressure of the working medium which is compressed and expanded in working space 7. Piston 1 and displacer 2 are configured to reciprocate at the same cycles with a phase difference therebetween of approximately 90°.

Working space 7 is further divided into two spaces by displacer 2. A first working space is a compression space 7*a* located between piston 1 and displacer 2. A second working space is an expansion space 7*b* at the top of cylinder 3.

Compression space 7*a* and expansion space 7*b* are coupled via a regenerator 4. Regenerator 4 is formed of a mesh-shaped copper member for example.

The working medium in expansion space 7*b* generates cold heat at a cold head 3*c* at the top of cylinder 3. Reverse Stirling heat cycle such as this principle of generation of cold heat is a well-known art and thus description thereof is not provided here.

Stirling refrigerator 100E of the above-discussed structure, however, has following problems.

First, components of coil/bobbin 9*a* and outer yoke 9*b* have low strength and thus these components must be handled carefully in assembly of mass production. Second, in the structure as shown in FIG. 12 with piston support spring 5 and displacer support spring 6 fixed to casing 15, support member 31 fixed to casing 15 has to be extended to the positions of piston support spring 5 and displacer support spring 6, resulting in increase in size of the outer shape of casing 15 to make it necessary to increase the thickness of a material for casing 15 in terms of strength.

DISCLOSURE OF THE INVENTION

One object of the present invention is to provide a Stirling refrigerator by which handling in assembly of mass production of a coil/bobbin and an outer yoke of an outer yoke body constituting a linear motor can be facilitated and a casing can be reduced in size of its outer shape.

A Stirling refrigerator according to the present invention includes a casing, a cylinder provided in the casing, a piston provided in the cylinder to be made movable in a reciprocating manner in the axial direction of the cylinder by a linear motor provided externally to the cylinder, and a displacer provided in the cylinder to form a compression space between itself and the piston in the cylinder and to be movable in a reciprocating manner in the axial direction. The linear motor includes an inner yoke provided on the outer periphery of the cylinder, an outer yoke assembly placed externally to the inner yoke to face the inner yoke, and a permanent magnet placed in a gap between the inner yoke and the outer yoke assembly and coupled to the piston. The outer yoke assembly includes a bobbin/coil placed to face the inner yoke, an outer yoke provided to cover the bobbin/coil from the casing and in the axial direction, and a pair of ring-shaped holding members provided to hold the outer yoke therebetween in the axial direction.

The pair of ring-shaped holding members can thus be provided to achieve an integral structure holding, between the paired holding members, the coil/bobbin and the outer yoke of the outer yoke body which constitutes the linear motor. Accordingly, an integral strength can be obtained from the outer yoke assembly in assembly of the Stirling refrigerator to facilitate handling of the outer yoke assembly.

Preferably, according to the present invention, the Stirling refrigerator further includes displacer support means for elastically supporting the displacer to make the displacer movable in a reciprocating manner in the cylinder, and the displacer support means includes an elastic member coupled to the displacer and elastic-member support means for supporting the elastic member and provided on an end in the axial direction of the outer yoke assembly.

Preferably, according to the present invention, the Stirling refrigerator further includes piston support means for elastically supporting the piston with respect to the casing to make the piston movable in a reciprocating manner in the cylinder, and displacer support means for elastically supporting the displacer with respect to the casing to make the displacer movable in a reciprocating manner in the cylinder. The piston support means includes a first elastic member coupled to the piston and first-elastic-member support means for supporting the first elastic member and fixed to an end in the axial direction of the outer yoke assembly. The displacer support means includes a second elastic member coupled to the displacer and second-elastic-member support means for supporting the second elastic member and fixed to the end in the axial direction of the outer yoke assembly.

This structure can be employed to place the elastic-member support means, the first-elastic-member support means and the second-elastic-member support means on the upper side of the linear motor and thereby reduce the size of the outer shape of the casing. Accordingly, in terms of the strength of the casing, the thickness of the casing can be reduced and thus the weight and cost of the stirling refrigerator can be reduced.

As for the conventional structure, the support means is constituted of a long member passing along the side of the linear motor, resulting in accidental deformation of the long member in assembly of the Stirling refrigerator to make it difficult to define the center of axis of each component. According to the present invention, such a situation can be avoided.

Still preferably, according to the present invention, the first elastic member and the second elastic member are substantially disk-shaped, and the first elastic member has an outer diameter smaller than that of the second elastic member and the first-elastic-member support means is placed at a height lower than that of second-elastic-member support means.

This structure can be employed to prevent one of respective fastening parts at which the first-elastic-member support means and the second-elastic-member support means are respectively fastened from influencing the other fastening part. In other words, as these components are independently fixed to the elastic member support means, the elastic members never come apart and thus the Stirling refrigerator can be improved in its reliability.

Still preferably, according to the present invention, at least one of the elastic-member support means the first-elastic-member support means and the second-elastic-member support means is provided at a ring-shaped base plate. Still more preferably, according to the present invention, at least one of the elastic-member support means, the first-elastic-member support means and the second-elastic-member support means is post-shaped. This structure can be employed to improve the working efficiency in attachment of the first elastic member and the second elastic member each.

Still preferably, according to the present invention, one holding member of the paired holding members is provided integrally with the ring-shaped base plate. This structure can be employed to reduce the number of components.

BEST MODES FOR CARRYING OUT THE INVENTION

Figure 12:
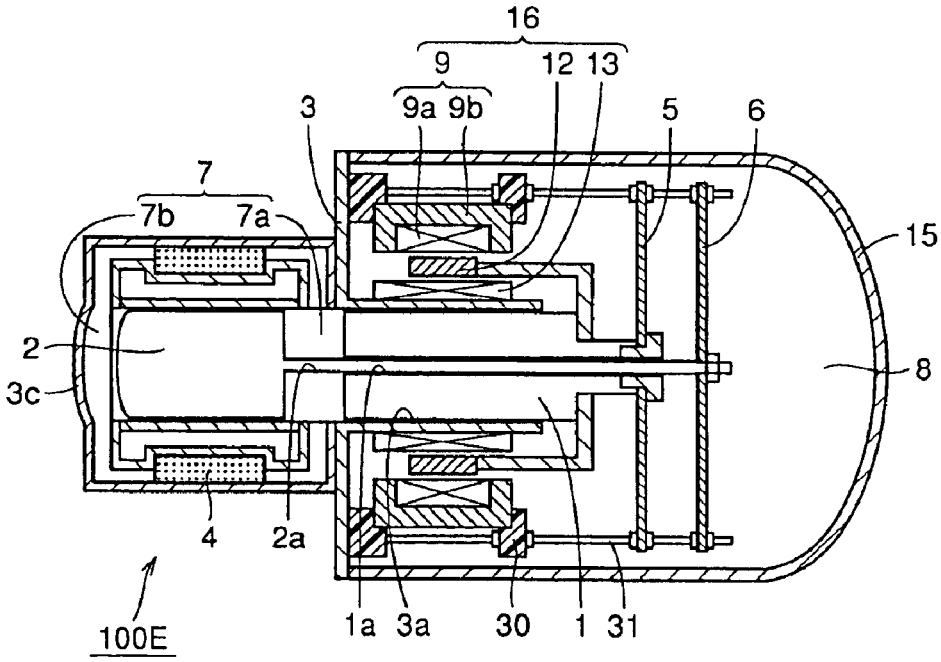
FIG.12 PRIOR ART
FIG. 12 is a cross-sectional view schematically showing a structure of a Stirling refrigerator according to a conventional art.

A structure of a Stirling refrigerator according to each embodiment of the present invention is hereinafter described with reference to the drawings. It is noted that any component which is the same as or corresponding to the component of the conventional art described in connection with FIG. 12 is denoted by the same reference numeral and description thereof is not repeated here.

First Embodiment

Figure 1:
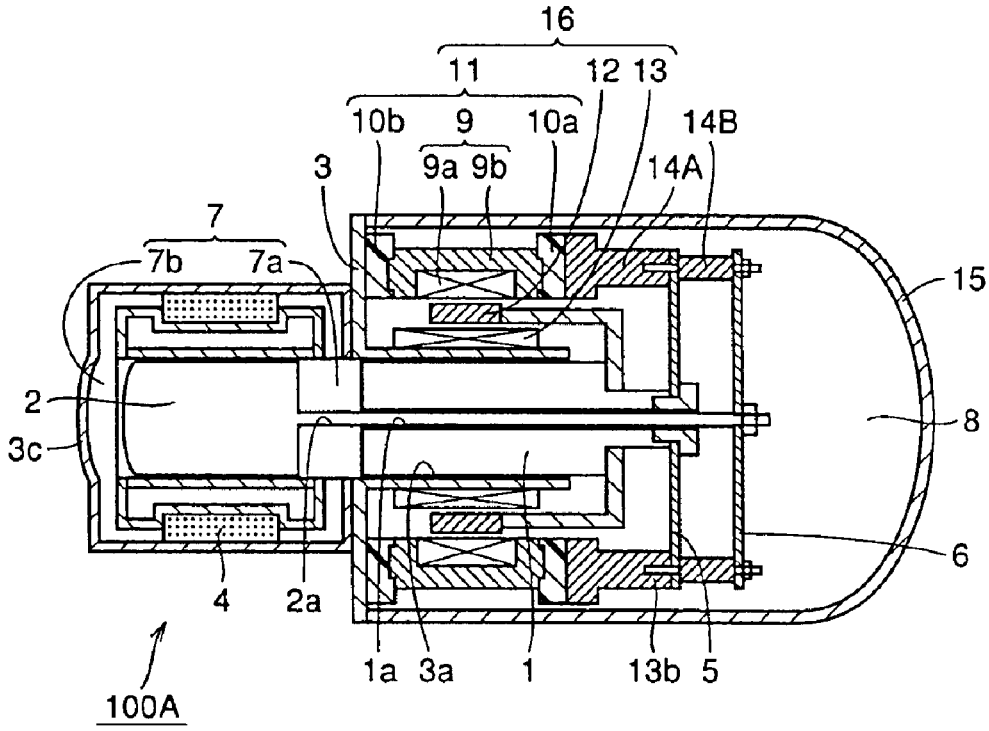
FIG. 1 is a cross-sectional view showing an entire structure of a Stirling refrigerator 100A according to a first embodiment.
Figure 3A:
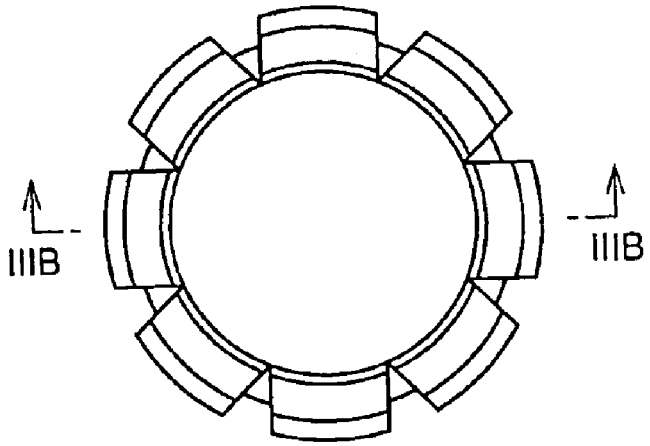
FIGS. 3A and 3B are second drawings showing the structure of outer yoke body 9.
Figure 3B:
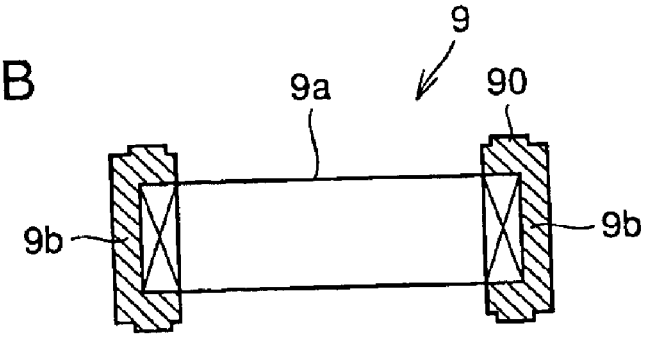
Figure 4A:
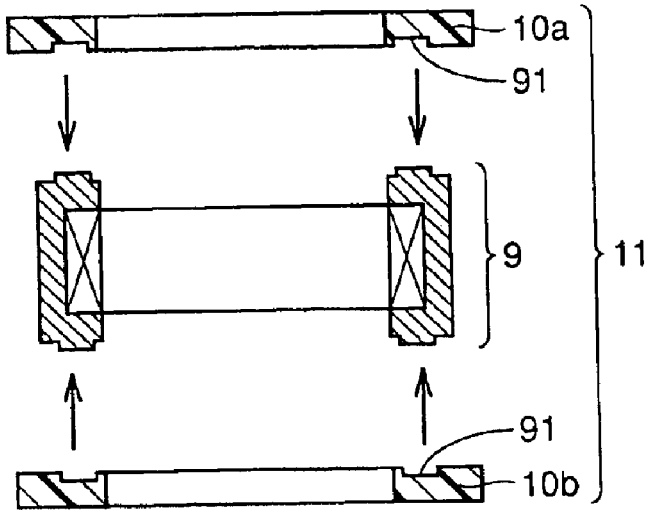
FIGS. 4A and 4B show a structure of an outer yoke assembly 11 and assembling thereof.
Figure 4B:
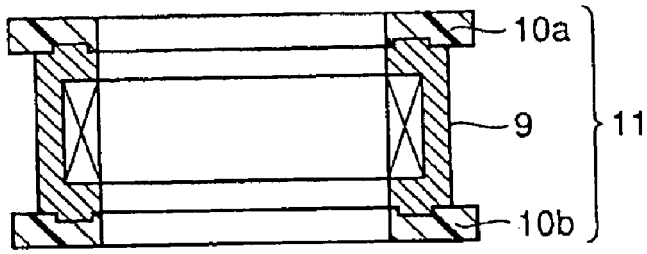
Figure 5A:
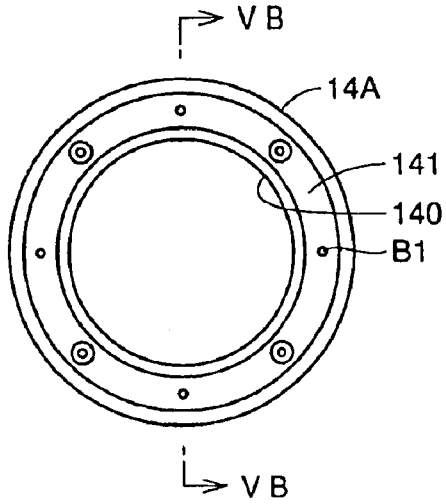
FIGS. 5A and 5B show a structure of a piston-support-spring support member 14A.
Figure 5B:
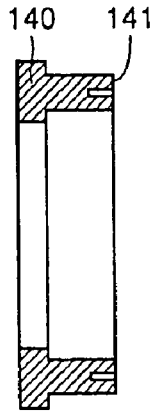

Referring to FIGS. 1–5B, a structure of a Stirling refrigerator 100A according to a first embodiment is described. FIG. 1 is a cross-sectional view showing the entire structure of Stirling refrigerator 100A, FIGS. 2A–4B show a structure of an outer yoke assembly 11 and assembling thereof, and FIGS. 5A and 5B show a structure of a piston-support-spring support member 14A.

Structure of Stirling Refrigerator 100A

Referring to FIG. 1, Stirling refrigerator 100A has a basic structure which is the same as that of Stirling refrigerator 100E described in connection with FIG. 12, and a characteristic structure of Stirling refrigerator 100A in this embodiment is that an outer yoke assembly 11 is provided as an outer yoke constituting a linear motor 16 and that, for fixing a piston support spring 5 and a displacer support spring 6 as a first elastic member and a second elastic member respectively, a piston-support-spring support member 14A and a displacer-support-spring support member 14B supported by outer yoke assembly 11 are employed respectively as first-elastic-member support means and second-elastic-member support means.

Structure of Outer Yoke Assembly 11

A structure of outer yoke assembly 11 is described with reference to FIGS. 2A–4B. Referring to FIGS. 2A, 2B, 3A and 3B, an outer yoke body 9 has a bobbin/coil 9*a* in the shape of a ring with a copper wire wound around a bobbin, and an outer yoke 9*b* divided into a plurality of sections each formed of stacked steel plates for the yoke, outer yoke 9*b* being fixed to the outer periphery of bobbin/coil 9*a* with an adhesive.

Figure 2A:
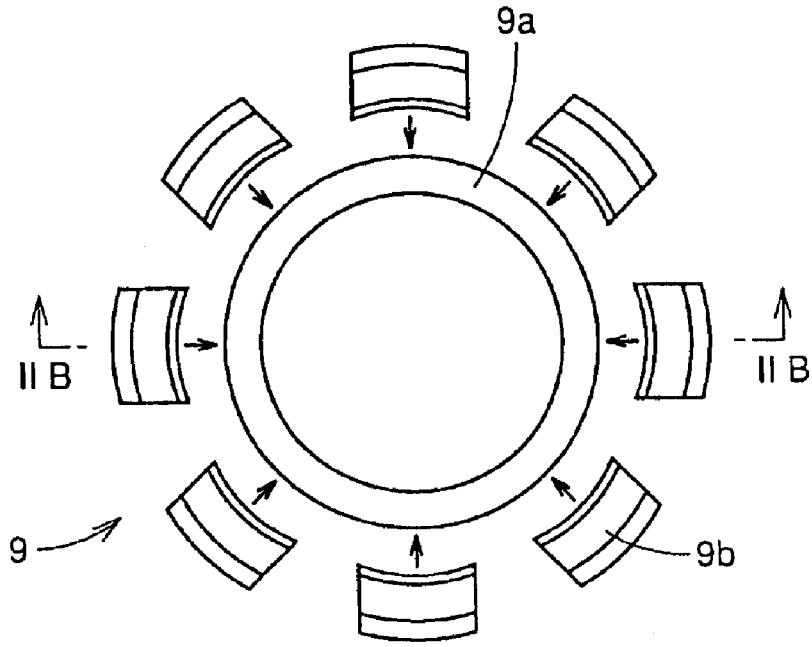
FIGS. 2A and 2B are first drawings showing a structure of an outer yoke body 9.
Figure 2B:
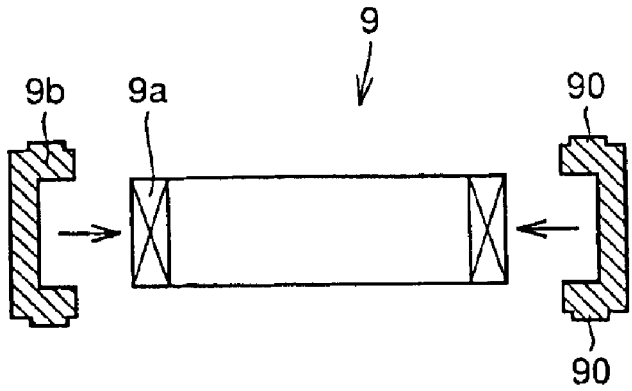

FIGS. 2A and 2B show a state before outer yoke 9*b* is fit on the outer periphery of ring-shaped bobbin/coil 9*a*, FIG.

2A showing a structure in plain view and FIG. 2D showing a cross-sectional structure along the plane indicated by arrows IIB—IIB in FIG. 2A. FIGS. 3A and 3B show a state in which outer yoke 9*b* is fit on the outer periphery of ring-shaped bobbin/coil 9*a*, FIG. 3A showing a structure in plan view and FIG. 3B showing a cross-sectional structure along the plane indicated by arrows IIIB—IIIB in FIG. 3A. On the upper surface and the lower surface of outer yoke 9*b* respectively, protrusions 90 are provided for defining positions at which an upper holding plate 10*a* and a lower holding plate 10*b* described hereinbelow are to be attached.

Referring to FIGS. 4A and 4B, on the upper side and the lower side of outer yoke body 9, upper holding plate 10*a* and lower holding plate 10*b* in the shape of a ring made of a resin material having a relatively high stiffness are attached to hold outer yoke body 9 therebetween in the axial direction, and thus outer yoke assembly 11 is completed. Upper holding plate 10*a* and lower holding plate 10*b* have respective depressions 91 in which protrusions 90 provided to outer yoke 9*b* are fit respectively. FIG. 4A shows a cross-sectional structure before upper holding plate 10*a* and lower holding plate 10*b* are attached to outer yoke body 9, and FIG. 4B shows a cross-sectional structure in the state in which upper holding plate 10*a* and lower holding plate 10*b* are attached to outer yoke body 9.

Referring again to FIG. 1, outer yoke assembly 11 structured as described above is fixed with respect to cylinder 3 by using bolts (not shown) in such a manner that the center of the axis of cylinder 3 and that of outer yoke assembly 11 match each other. In order to allow the axis center of cylinder 3 and that of outer yoke assembly 11 to match each other, a jig (not shown) is used.

Structure of Piston-Support-Spring Support Member 14A and Displacer-Support-Spring Support Member 14B Referring to FIGS. 5A and 5B, a structure of piston-support-spring support member 14A is described. FIG. 5A shows a structure in plan view and FIG. 5B shows a cross-sectional structure along the plane indicated by arrows VB—VB in FIG. 5A. Piston-support-spring support member 14A is made of a brass or resin material for example and includes a base portion 140 formed of a ring-shaped base plate and a support portion 141 supporting piston support spring 5. Support portion 141 has a plurality of screw holes B1 for fastening piston support spring 5 and displacer-support-spring support member 14B described hereinbelow.

As shown in FIG. 1, displacer-support-spring support member 14B is in the shape of a ring having a uniform thickness and made of a brass or resin material for example similarly to piston-support-spring support member 14A.

Piston-support-spring support member 14A is fixed with respect to upper holding plate 10*a* of outer yoke assembly 11 with bolts (not shown). For positioning of piston-support-spring support member 14A with respect to upper holding plate 10*a*, a jig (not shown) is used. Displacer-support-spring support member 14B is also fixed with respect to piston-support-spring support member 14A with bolts.

Function and Effect

The Stirling refrigerator according to this embodiment employs an integral structure of outer yoke assembly 11 constituting linear motor 16 and having coil/bobbin 9*a* and outer yoke 9*b* that are held between upper holding plate 10*a* and lower holding plate 10*b* to obtain an integral strength from outer yoke assembly 11 and facilitate handling of outer yoke assembly 11.

In attachment of outer yoke assembly 11 to cylinder 3, outer yoke assembly 11 is surely positioned with respect to cylinder 3 to make it possible to simultaneously position coil/bobbin 9*a*, outer yoke 9*b*, piston-support-spring support member 14A and displacer-support-spring support member 14B with respect to cylinder 3 and accordingly shorten the cycle time for manufacturing the Stirling refrigerator.

Piston-support-spring support member 14A and displacer-support-spring support member 14B are placed at the upper part corresponding to an end in the axial direction of linear motor 16 and thus the size of the outer shape of casing 15 can be reduced. Accordingly, casing 15 can be reduced in thickness in terms of the strength of casing 15 and thus the Stirling refrigerator can be reduced in weight as well as cost.

In addition, while the support member of the conventional structure is constituted of a long member passing along the side of linear motor 16, resulting in accidental deformation of the long member in assembly of the Stirling refrigerator to make it difficult to define the center of the axis of each component, such a situation can be avoided here.

Second Embodiment

Figure 6:
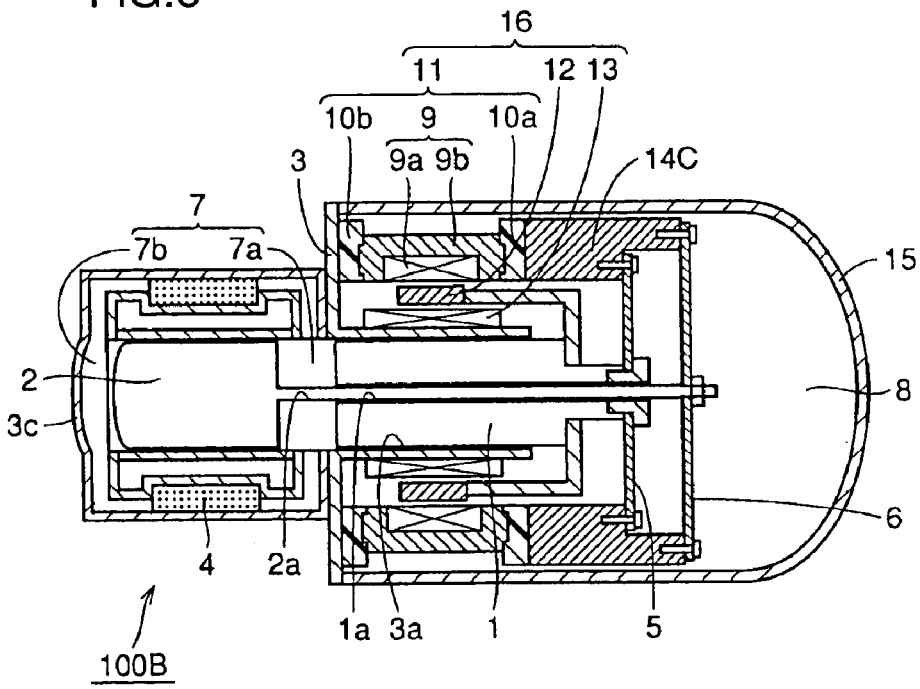
FIG. 6 is a cross-sectional view showing an entire structure of a Stirling refrigerator 100B according to a second embodiment.
Figure 7A:
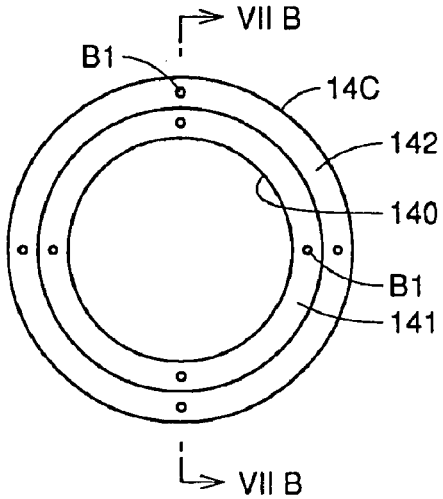
FIGS. 7A and 7B show a structure of a piston-support-spring support member 14C.
Figure 7B:
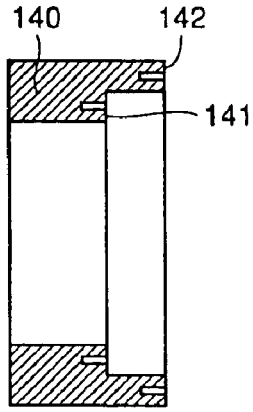

Referring to FIGS. 6, 7A and 7B, a structure of a Stirling refrigerator 100B according to a second embodiment is described. FIG. 6 is a cross-sectional view showing the entire structure of Stirling refrigerator 100B, and FIGS. 7A and 7B show a structure of a support-spring support member 14C.

Structure of Stirling Refrigerator 100B

As compared with the structure of Stirling refrigerator 100A in the first embodiment discussed above, Stirling refrigerator 100B of the second embodiment includes a support-spring support member 14C instead of piston-support-spring support member 14A and displacer-support-spring support member 14B. An outer yoke assembly 11 in this embodiment has the same structure as that of the Stirling refrigerator 100A in the first embodiment.

Structure of Support-Spring Support Member 14C

According to this embodiment, a piston support spring 5 and a displacer support spring 6 have different outer shapes respectively, and support-spring support member 14C supports both of piston support-spring 5 and displacer support spring 6. Referring to FIGS. 7A and 7B, support-spring support member 14C has a structure as described below. FIG. 7A shows a structure in plan view and FIG. 7B shows a cross-sectional structure along the plane indicated by arrows VIIB—VIIB in FIG. 7A. Support-spring support member 14C has a base portion 140 formed of a ring-shaped base plate, as well as a support portion 141 supporting piston support spring 5 and a support portion 142 supporting displacer support spring 6 having respective outer shapes different from each other and being attached at different heights respectively. Support-spring support member 14C is made of a brass or resin member for example. Further, support portions 141 and 142 have a plurality of screw holes B1 for fixing piston support spring 5 and displacer support spring 6.

Function and Effect

The Stirling refrigerator of the second embodiment also achieves the function and effect similar to those of the first embodiment as discussed above. Moreover, piston support spring 5 and displacer support spring 6 are formed differently in outer shape and are fixed at different positions and accordingly, it never occurs that one of the fastening parts at which piston support spring 5 and displacer support spring 6 are respectively fastened influences the other fastening part.

Third Embodiment

Figure 8:
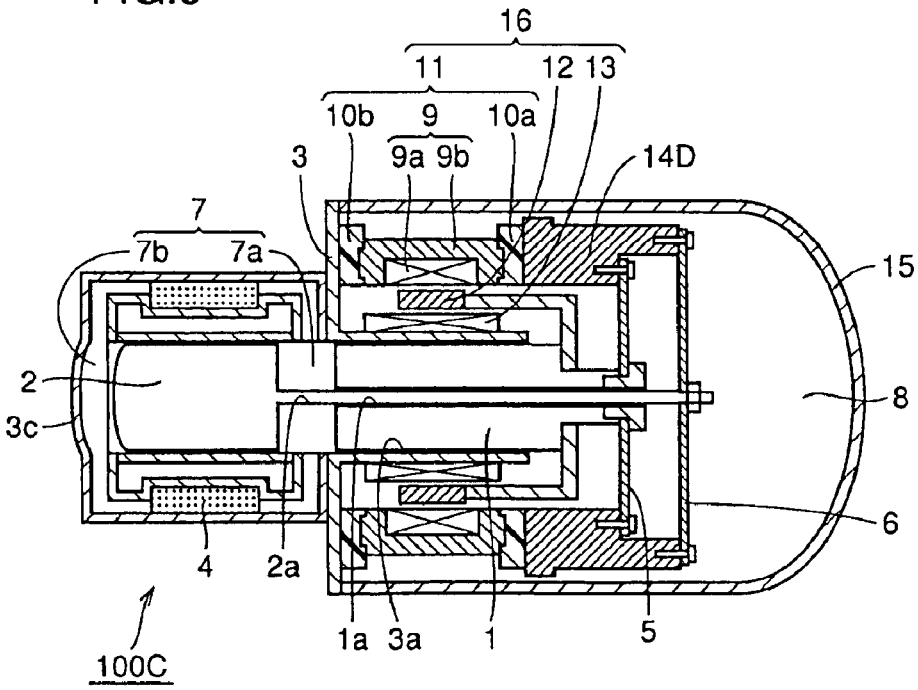
FIG. 8 is a cross-sectional view showing an entire structure of a Stirling refrigerator 100C according to a third embodiment.
Figure 9A:
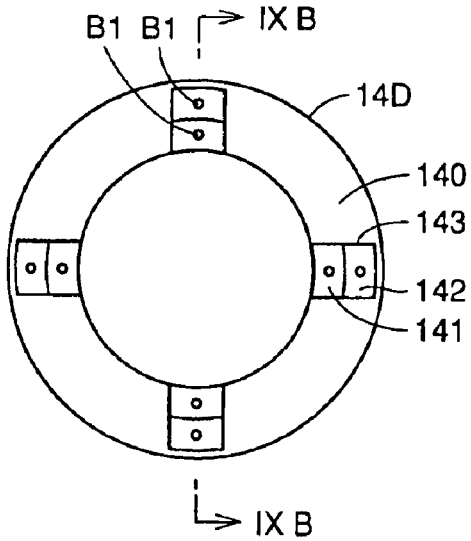
FIGS. 9A and 9B show a structure of a piston-support-spring support member 14D.
Figure 9B:
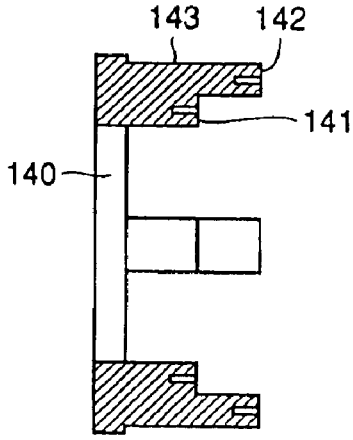

Referring to FIGS. 8, 9A and 9B, a Stirling refrigerator 100C of a third embodiment has a structure as described below. FIG. 8 is a cross-sectional view showing the entire structure of Stirling refrigerator 100C and FIGS. 9A and 9B show a structure of a support-spring support member 14D.

Structure of Stirling Refrigerator 100C

As compared with the structure of Stirling refrigerator 100B of the second embodiment discussed above, support-spring support member 14D of Stirling refrigerator 100C of the third embodiment has post-shaped support portions for supporting a piston support spring 5 and a displacer support spring 6. An outer yoke assembly 11 here has the same structure as that of Stirling refrigerator 100A of the first embodiment.

Structure of Support-Spring Support Member 14D

Referring to FIGS. 9A and 9B, support-spring support member 14D has a structure as described below. FIG. 9A shows a structure in plan view and FIG. 9B shows a cross-sectional structure along the plane indicated by arrows IXB—IXB in FIG. 9A. According to the third embodiment, as compared with support-spring support member 14C of the above-discussed second embodiment, support portions 141 and 142 for piston support spring 5 and displacer support spring 6 are provided at post-shaped portions 143 and post-shaped portions 143 are provided at four places at 90°-pitches. It is noted that the number and placement of post-shaped portions 143 are not limited to those of the third embodiment and are appropriately selected in terms of design on the condition that piston support spring 5 and displacer support spring 6 can be supported in a stable state.

Function and Effect

The Stirling refrigerator according to the third embodiment also achieves the function and effect similar to those of the first and second embodiments discussed above. Moreover, as support portions 141 and 142 are provided at post-shaped portions 143, working efficiency in attachment of piston support spring 5 and displacer support spring 6 can be improved. Further, the Stirling refrigerator can be reduced in weight.

Fourth Embodiment

Figure 10:
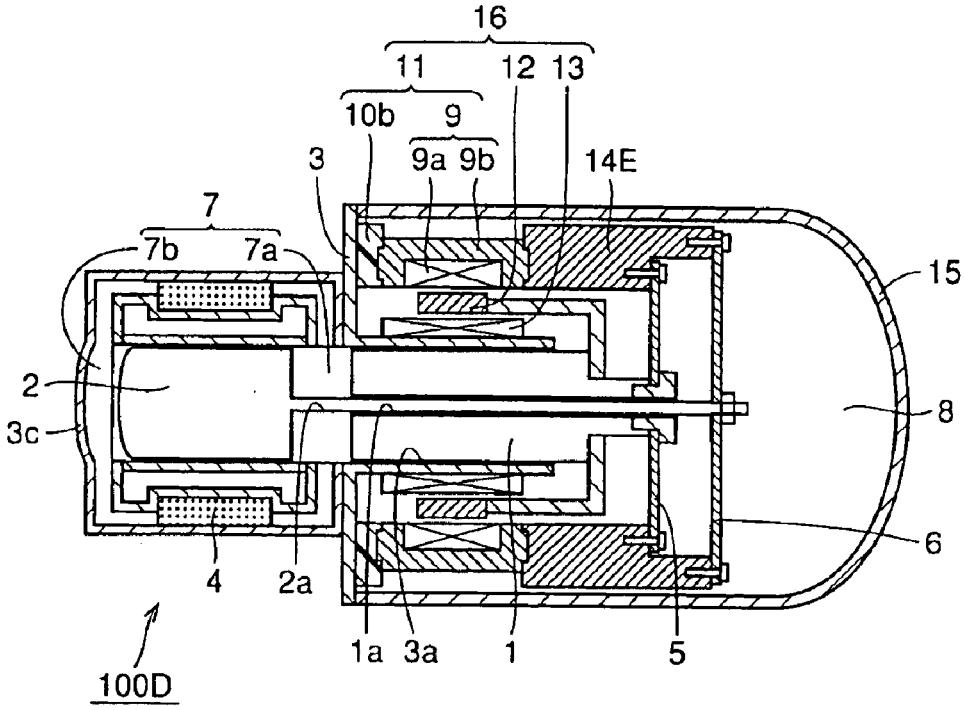
FIG. 10 is a cross-sectional view showing an entire structure of a Stirling refrigerator 100D according to a fourth embodiment.
Figure 11A:
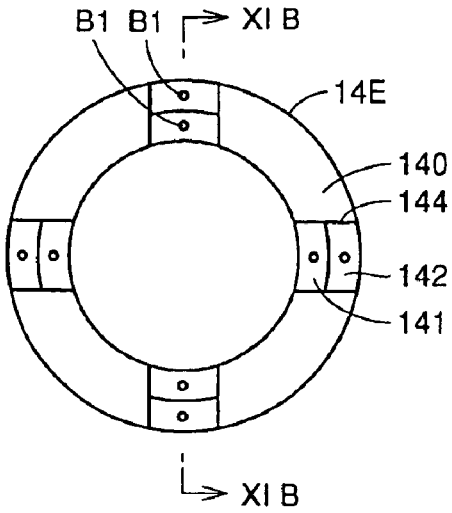
FIGS. 11A and 11B show a structure of a piston-support-spring support member 14E.
Figure 11B:
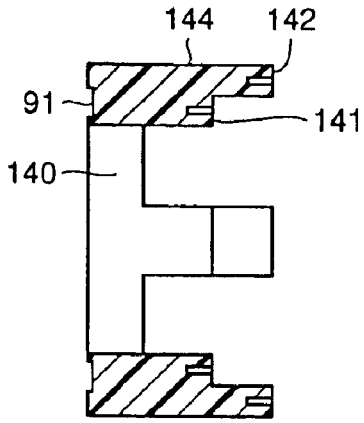

Referring to FIGS. 10, 11A and 11B, a Stirling refrigerator 100D of a fourth embodiment has a structure as described below. FIG. 10 is a cross-sectional view showing the entire structure of Stirling refrigerator 100D and FIG. 11 shows a structure of a support-spring support member 14E.

Structure of Stirling Refrigerator 100D

As compared with the structure of Stirling refrigerator 100C of the third embodiment discussed above, Stirling refrigerator 100D of the fourth embodiment similarly has post-shaped support portions for supporting a piston support spring 5 and a displacer support spring 6, while an upper holding plate 10*a* constituting an outer yoke assembly 11 is formed at a base 140 formed of a ring-shaped base plate.

Structure of Support-Spring Support Member 14E

Referring to FIGS. 11A and 11B, support-spring support member 14E has a structure as described below. FIG. 11A shows a structure in plan view and FIG. 11B shows a cross-sectional structure along the plane indicated by arrows XIB—XIB in FIG. 11A. According to the fourth embodiment, as compared with support-spring support member 14D of the above-discussed third embodiment, a base 140 further serves as upper holding plate 10*a* constituting outer yoke assembly 11 by forming a depression 91 in which a protrusion 90 provided to an outer yoke 9*b* is fit, integrally with base 140.

Function and Effect

The Stirling refrigerator of the fourth embodiment also achieves the function and effect similar to those of the first to third embodiments discussed above. Moreover, by employing the integral structure in which upper holding plate 10*a* is integrally formed with support-spring support member 14E, the number of components can be reduced.

The embodiments disclosed above should be taken by way of illustration and example and not by way of limitation in terms of every respect. The scope of the present invention is defined not in the description above but in the appended claims and it is intended that the same includes all of modifications and variations equivalent in the meaning and within the scope of the invention.

INDUSTRIAL APPLICABILITY

The Stirling refrigerator according to the present invention has a pair of ring-shaped holding members to achieve an integral structure having the coil/bobbin and the outer yoke of the outer yoke body constituting a linear motor that are held between the holding members. Accordingly, in assembly of the Stirling refrigerator, the integral strength can be obtained from the outer yoke assembly to facilitate handling of the outer yoke assembly.

Moreover, the first-elastic-member support means and the second-elastic-member support means can be placed at an upper part of the linear motor to reduce the size of the outer shape of the casing. In terms of the strength of the casing, the thickness of the casing can thus be reduced and the Stirling refrigerator can be reduced in weight and cost.

What is claimed is:

1. A Stirling refrigerator comprising:

a casing (15);

a cylinder (3) provided in said casing (15);

a piston (1) provided in said cylinder (3) to be made movable in a reciprocating manner in the axial direction of said cylinder (3) by a linear motor (16) provided externally to said cylinder (3); and a displacer (2) provided in said cylinder (3) to form a compression space between itself and said piston (1) in said cylinder (3) and to be movable in a reciprocating manner in the axial direction, said linear motor (16) including an inner yoke (13) provided on an outer periphery of said cylinder (3), an outer yoke assembly (9) placed externally to said inner yoke (13) to face said inner yoke (13), and a permanent magnet (12) placed in a gap between said inner yoke (13) and said outer yoke assembly (9) and coupled to said piston (1), and said outer yoke assembly (9) including a bobbin/coil (9*a*) placed to face said inner yoke (13), an outer yoke (9*b*) provided to cover said bobbin/coil (9*a*) from said casing and in the axial direction, and a pair of ring-shaped holding members (10*a*, 10*b*) provided to hold said outer yoke (9*b*) therebetween in the axial direction.

2. The Stirling refrigerator according to claim 1, further comprising:

displacer support means (6, 14B, 14C, 14D, 14E) for elastically supporting said displacer (2) to make said displacer (2) movable in a reciprocating manner in said cylinder (3), wherein said displacer support means (6, 14B, 14C, 14D, 14E) includes an elastic member (6) coupled to said displacer (2), and elastic-member support means (14B, 14C, 14D, 14E) for supporting said elastic member (6) and provided on an end in the axial direction of said outer yoke assembly (9).

3. The Stirling refrigerator according to claim 2, wherein said elastic-member support means (14B) provided at a ring-shaped base plate (140).

4. The Stirling refrigerator according to claim 2, wherein said elastic-member support means (14B) is post-shaped.

5. The Stirling refrigerator according to claim 1, further comprising:

piston support means (5, 14A, 14C, 14D, 14E) for elastically supporting said piston (1) to make said piston (1) movable in a reciprocating manner in said cylinder (3); and displacer support means (6, 14B, 14C, 14D, 14E) for elastically supporting said displacer (2) to make said displacer (2) movable in a reciprocating manner in said cylinder (3), where in said piston support means (5, 14A, 14C, 14D, 14E) includes a first elastic member (5) coupled to said piston (1), and first-elastic-member support means (14A) for supporting said first elastic member (5) and provided on an end in the axial direction of said outer yoke assembly (9), and said displacer support means (6, 14B, 14C, 14D, 14E) includes a second elastic member (6) coupled to said displacer (2), and second-elastic-member support means (14B, 14C, 14D, 14E) for supporting said second elastic member (6) and provided on the end in the axial direction of said outer yoke assembly (9).

6. The Stirling refrigerator according to claim 5, wherein said first elastic member (5) and said second elastic member (6) are substantially disk-shaped, and said first elastic member (5) has an outer diameter smaller than that of said second elastic member (6) and said first-elastic-member support means (14A) is placed at a height lower than that of said second-elastic-member support means (14B).

7. The Stirling refrigerator according to claim 5, wherein at least one of said first-elastic-member support means (14A) and said second-elastic-member support means (14B) are provided at a ring-shaped base plate (140).

8. The Stirling refrigerator according to claim 7, wherein one holding member (10*a*) of said paired holding members (10*a*, 10*b*) is provided integrally with said ring-shaped base plate (140).

9. The stirling refrigerator according to claim 5, wherein at least one of said first-elastic-member support means (14A) and said second-elastic-member support means (14B) are post-shaped.

* * * * *